US008481869B2

(12) United States Patent
Coulson et al.

(10) Patent No.: US 8,481,869 B2
(45) Date of Patent: Jul. 9, 2013

(54) TAKE-UP DEVICE FOR CABLE, CORD AND THE LIKE

(75) Inventors: Richard Robert Coulson, Markham (CA); Joel John Yatscoff, Toronto (CA); James Davidson Benzie, Brampton (CA)

(73) Assignee: Arconas Corporation, Mississauga (CA)

( * ) Notice: Subject to any disclaimer, the term of this patent is extended or adjusted under 35 U.S.C. 154(b) by 14 days.

(21) Appl. No.: 13/064,696

(22) Filed: Apr. 8, 2011

(65) Prior Publication Data

US 2012/0006706 A1 Jan. 12, 2012

(51) Int. Cl.
*H02G 3/18* (2006.01)

(52) U.S. Cl.
USPC ..... 174/650; 174/68.3; 174/651; 174/654; 361/807

(58) Field of Classification Search
USPC ..... 361/807; 248/73; 174/48, 68.3, 650
See application file for complete search history.

(56) References Cited

U.S. PATENT DOCUMENTS

| | | | | |
|---|---|---|---|---|
| 2,763,707 | A | 9/1956 | Soderberg | |
| 3,337,682 | A | 8/1967 | Swett | |
| 4,017,137 | A | 4/1977 | Parks | |
| 4,475,649 | A * | 10/1984 | Haarbosch | 206/702 |
| 4,944,694 | A | 7/1990 | Dorn | |
| 5,118,907 | A * | 6/1992 | Stout et al. | 174/135 |
| 5,231,562 | A | 7/1993 | Pierce et al. | |
| 5,255,866 | A * | 10/1993 | Campolo | 242/388.1 |
| 5,421,457 | A * | 6/1995 | Listenberger | 206/388 |
| 5,924,892 | A | 7/1999 | Ferracina | |
| 6,198,047 | B1 | 3/2001 | Barr | |
| 6,252,171 | B1 * | 6/2001 | Barr | 174/95 |
| 7,038,126 | B2 | 5/2006 | Solet | |
| H2226 | H | 11/2008 | Pi | |
| 7,553,174 | B2 | 6/2009 | Roepke et al. | |
| 2005/0011657 | A1 * | 1/2005 | Johnston et al. | 174/48 |

* cited by examiner

*Primary Examiner* — Tuan T Dinh
*Assistant Examiner* — Steven Sawyer
(74) *Attorney, Agent, or Firm* — Dinesh Agarwal, P.C.

(57) ABSTRACT

A take-up device for storing a flexible member, such as a cable, cord, flexible hose or tubing and the like, includes a housing for receiving a central portion of the flexible member in in a folded configuration with linear end portions thereof extending outwardly from the housing. The housing includes a member for holding an end portion of the flexible member.

6 Claims, 3 Drawing Sheets

TAKE-UP DEVICE FOR CABLE, CORD AND THE LIKE

CROSS-REFERENCE TO RELATED APPLICATIONS

The present application claims priority on prior U.S. Provisional Application Ser. No. 61/324,783, filed Apr. 16, 2010, which is hereby incorporated herein in its entirety by reference.

FIELD OF THE INVENTION

This invention relates generally to a novel container for temporarily storing excess length of a cord, cable or hose when in use. More particularly the container according to the invention is for a cable used to interconnect power outlets in a system of electrical or computer equipment, whereby the free lengths of cable extending from the container between interconnecting power modules can easily be dressed to a desired length and degree of tautness.

BACKGROUND OF THE INVENTION

Storage containers and storage container kits for storing electronic devices and wires or cables have been devised for particular applications ever since electrical cords have been used with home appliances, such as lamps. An exposed and lengthy run of cord between a power outlet and an appliance is both unsightly and potentially dangerous. U.S. Pat. No. 2,763,707 (Soderberg) and U.S. Pat. No. 3,337,682 both disclose containers for taking up and storing the slack in wires. In the device of U.S. Pat. No. 4,944,694, a rectangular container is provided with pegs around which extra cable can be wound and stored.

In other devices intended to contain and organize electronic wires and devices when they are in use, the container is itself provided with linking power or computer outlets, as exemplified by U.S. Pat. No. 5,231,562 (Pierce et al.) and U.S. Pat. No. 5,924,892 (Ferracina et al).

The device of our invention which we refer to as the CABLE EATER™, was developed chiefly for the purpose of managing the cords when installing modules on seating to provide power for personal electronic devices. In particular it was desired to afford airport customers easy access to electrical power for their laptops, Blackberries™ and other personal electronics. It has always proved difficult to run cables between these outlets in a tidy manner while still allowing enough extra length for easy and flexible repositioning of the furniture. As has been the case in so many practical applications, surplus lengths of wires associated with electrical devices present problems of management for aesthetic and safety reasons.

SUMMARY OF THE INVENTION

A take-up device for cable, cord, flexible hose or tubing and the like according to the invention comprises a hollow housing with a longitudinal slot formation for receiving a central portion of the cable or cord in a folded configuration with linear end portions thereof extending outwardly from respective ends of the slot or recesses at the ends of the housing. Each end of the housing is provided with a slotted capping member for holding respective ends of the portion of cable or cord taken up by the housing. This arrangement greatly simplifies installation of the stack into the housing for temporary storage.

Securement of the folded length of cable or cord within the body of the housing may optionally be enhanced by integral inwardly curved flaps along opposite sides of the slot, serving as a barrier to the unfolding of sections of the cable that were snug-fit through the slot formation into the housing interior, or by providing exterior means for receiving and gripping the walls of the housing to either side of said slot formation.

DETAILED DESCRIPTION OF THE DRAWINGS

In the detailed description of a preferred embodiment of the invention which follows, reference will be made to the attached drawing figures, in which.

DETAILED DESCRIPTION AND PREFERRED EMBODIMENT

As seen in FIGS. 1, 2, 3 and 4, the CABLE EATER comprises an elongate hollow housing 10 having an upper portion 10*a* of generally circular symmetry and a less convex bottom surface portion 10*b*. The housing includes an upper longitudinal slot opening into the interior channel of the housing, to receive folds of cable 14 for storage, best seen in FIG. 3.

Figure 4A:
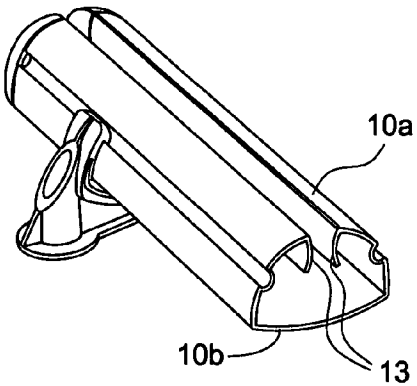
FIG. 4A is a sectional view along the arrows B-B in FIG. 4.
Figure 4:
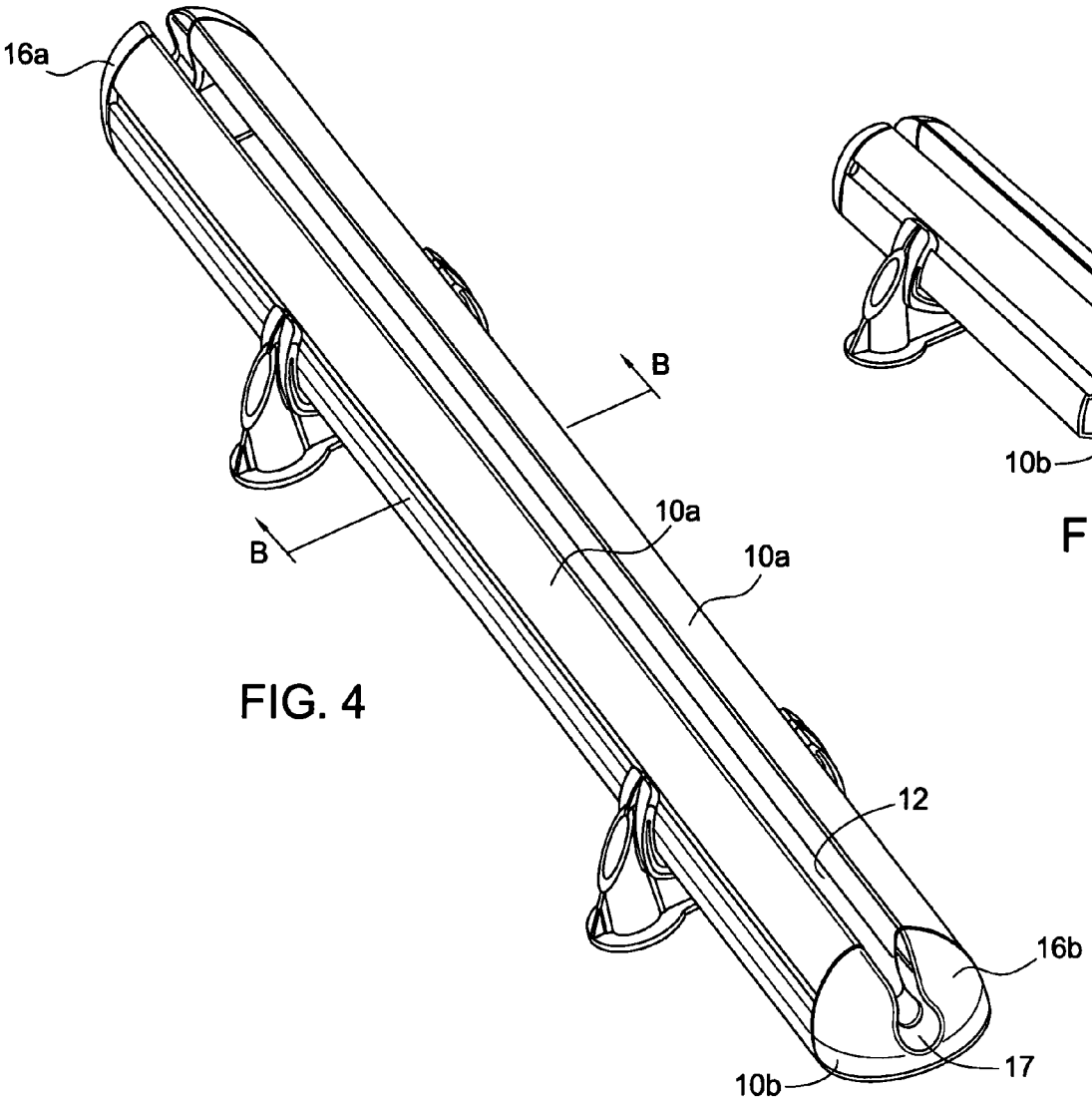
FIG. 4 is a perspective view from above and to one end of a take-up device according to the invention.

A cross-sectional view through the body of housing 10 is shown in FIG. 4A. To secure the folds of cable or cord in a stable configuration inside the housing channel, it is advantageous to provide that the slot 12 has along its inwardmost edges a pair of symmetrical downwardly directed convex flaps 13 to provide a press fit for cable pushed through the slot into the housing.

The perimetrical contour of the housing cross-section may be of different symmetry than that shown, provided that the interior volume of the housing is consistent with the space taken up by the folded lengths of cable to be temporarily stored therein. Too, multiple feeding slots into the housing may be provided where more than a single cable type is to be stored in one take-up device.

Figure 1:
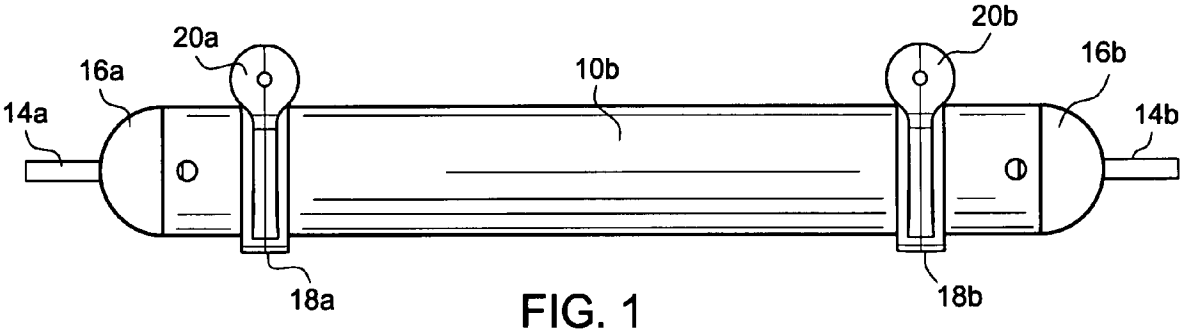
FIG. 1 is a schematic bottom plan view of a preferred embodiment cable take-up device, of the invention, with a section of electrical cable taken up in the interior and extending outwardly from the ends of the housing.
Figure 2:
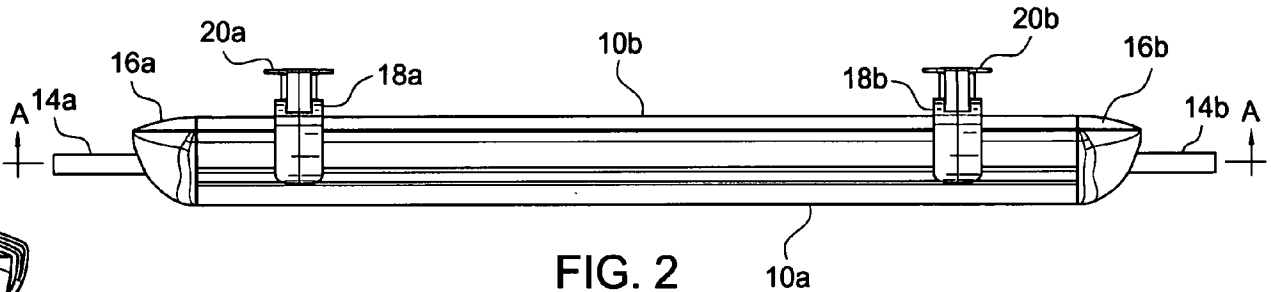
FIG. 2 is a side elevational view of the container of FIG. 1.
Figure 3:
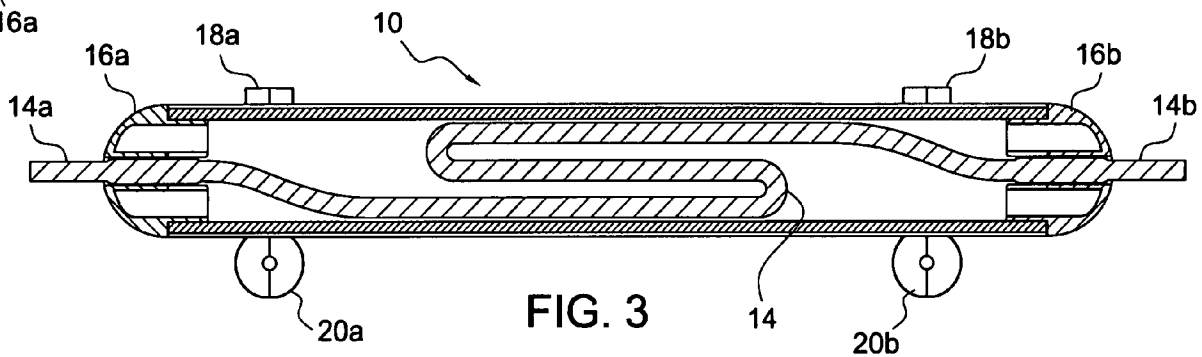
FIG. 3 is a sectional view along the arrows A-A in FIG. 2 showing a section of cable folded and stored in the interior of the housing.
Figure 2A:
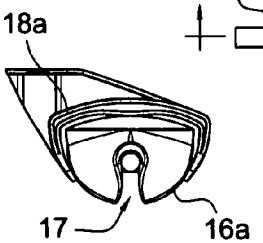
FIG. 2A is a partial end perspective view of the container of FIG. 2 showing the capping member and a portion of the gripping member nearest thereto.
Figure 5:
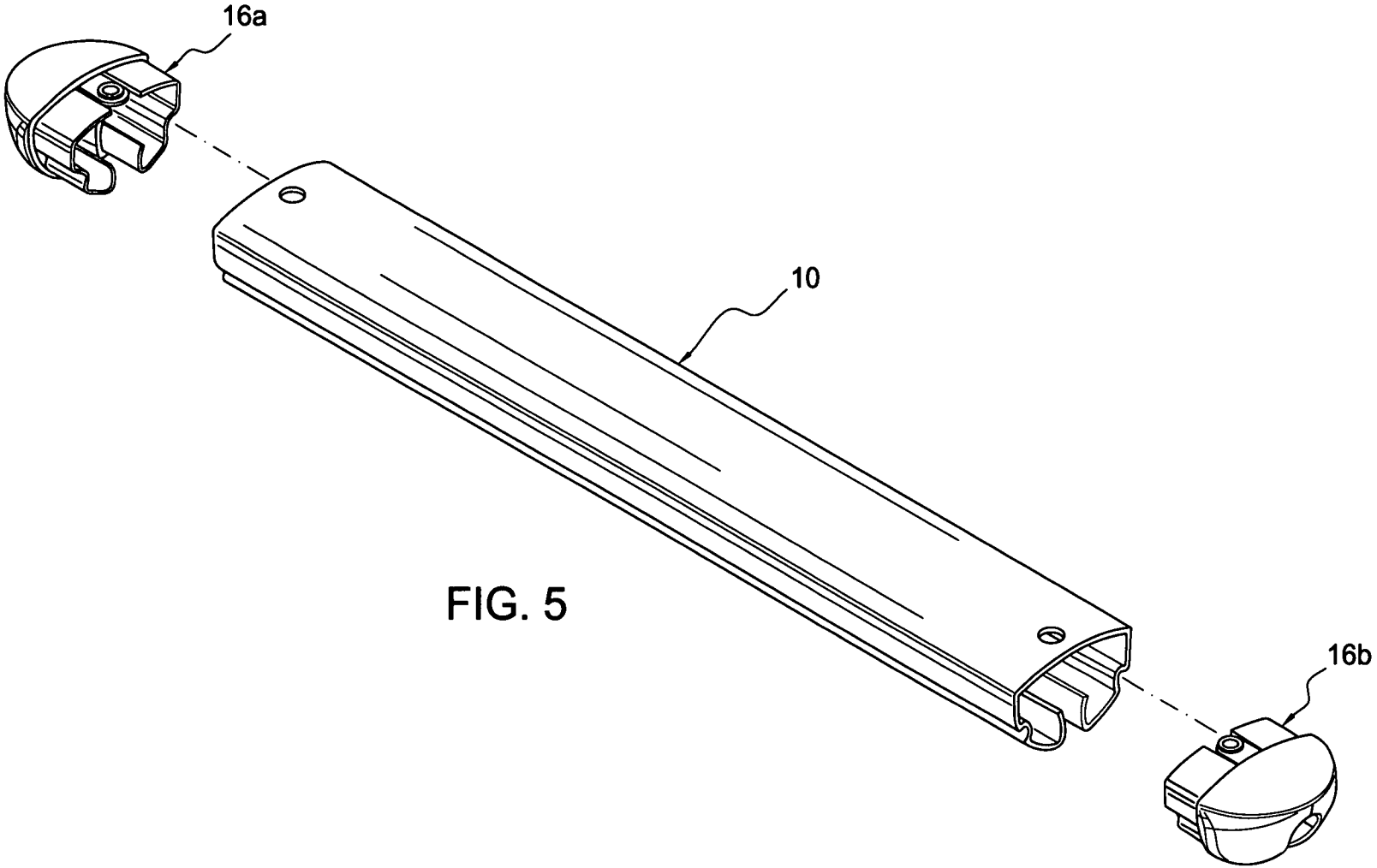
FIG. 5 is an exploded representation of the take-up device showing the end-caps displaced from the main body of the housing.

End-caps 16*a* and 16*b* for the housing are provided, having their own contoured fitting slots 17 for receiving and holding in a generally central position the cable ends 14*a* and 14*b*, as best seen in FIGS. 2 and 2A. FIG. 5 shows only a bottom perspective view of the housing 10 and end-caps 16*a* and 16*b* to show how these are assembled and disassembled.

The housing is preferably fabricated of extruded aluminum but a variety of engineered material will serve as well. To grip the housing body itself there are provided one or more gripping means, here in the form of concave, resilient cable members 18*a* and 18*b* adapted to receive and hold the housing. Each cradle member can include integral means 20*a* and 20*b* for fastening to a desired surface (e.g. under a table, between two seats on a row seating unit, etc.).

In use, cable 14 is routed through the CABLE EATER. The excess length of the cable is folded and then pressed through slot 12 in housing 10. To dress the free lengths 14*a* and 14*b* of the cable neatly, the cable is pulled reasonably tight and then pressed into the slots 17 of the end-caps 16*a* and 16*b* to hold them in place.

It will be obvious to those skilled in the art that various changes may be made without departing from the spirit and scope of the invention, for example, the kind and number of gripping means for the housing of the body, the particular shape of the hollow housing and so on. Accordingly, the invention is defined in the following claims and is not limited by the illustrations and description in the specification.

We claim:

1. A container for taking up and temporarily storing a central portion of an elongate flexible member connecting two fixed stations, comprising:

(a) a housing presenting along at least one surface thereof a longitudinal slot formation for receiving said central portion of the flexible member in a folded configuration with linear end portions of the member extending outwardly from respective ends of the housing; and (b) a retaining member at each end of the housing for receiving and releasably gripping a respective linear end portion of the flexible member to provide tautness on the respective linear end portion;

wherein:

each retaining member defines a contoured fitting slot having a cable opening cooperating with a slot region that opens to an outer edge of the retaining member such that the respective linear end portion can be slid though the slot region and gripped within the cable opening;

the retaining members are releasably connected to the housing;

each retaining member comprises a male portion that extends longitudinally into a respective end of the housing, wherein the cable opening extends longitudinally within the male portion enabling the linear end portion received therein to be releasably gripped along a length of the cable opening; and the housing comprises inwardly extending convex flap members integral with the edges of said longitudinal slot formation to provide a press fit for lengths of the central portion of said flexible member.

2. The container according to claim 1, wherein said elongate flexible member is an electrical cable and said fixed stations are power modules.

3. The container according to claim 2, wherein said housing is fabricated of an extruded aluminum said container further comprising gripping means for gripping the walls of the housing to either side of said slot formation.

4. The container according to claim 3, wherein said gripping means comprises at least one concave cradle member operable to receive and grip the housing, said cradle member including integral means for attachment to a mounting surface for the container.

5. A container for taking up and temporarily storing a central portion of an electrical cable, comprising:

(a) a housing presenting along at least one surface thereof a longitudinal slot formation for receiving said central portion of the electrical cable in a folded configuration with linear end portions of the cable extending outwardly from respective ends of the housing; and (b) an end cap at each end of the housing for receiving and releasably gripping a respective linear end portion of the flexible member to provide tautness on the respective linear end portion, wherein:

the ends caps are releasably attached to the housing and each end cap defines a contoured fitting slot having a cable opening cooperating with a slot region providing an opening at a perimeter of the end cap such that the respective linear end portion can be slid though the slot region and gripped within the cable opening; and the housing comprises inwardly extending, resilient flap members integral with the edges of said longitudinal slot formation to provide a press fit for lengths of the central portion of said flexible member.

6. The container of claim 5 wherein each end cap comprises a male portion that extends longitudinally into a respective end of the housing, wherein the cable opening extends longitudinally within the male portion enabling the linear end portion received therein to be releasably gripped along a length of the cable opening.

* * * * *